United States Patent [19]

Chauvet et al.

[11] Patent Number: 4,817,988

[45] Date of Patent: Apr. 4, 1989

[54] DEVICE FOR JOINING TWO SKIS TOGETHER WHICH IS READILY REMOVABLE WITH THE SKIS ON THE FEET

[75] Inventors: Alain Chauvet, Le Bouscat; Didier Bondoux, Paris, both of France

[73] Assignees: Alain Chauvet; S. A. Prisme, both of France

[21] Appl. No.: 131,723

[22] Filed: Dec. 11, 1987

[30] Foreign Application Priority Data

Dec. 12, 1986 [FR] France ..... 86 17531

[51] Int. Cl.[4] ..... A63C 11/00

[52] U.S. Cl. ..... 280/817; 280/818

[58] Field of Search ..... 280/817, 818, 21 R, 280/809

[56] References Cited

U.S. PATENT DOCUMENTS 3,171,667 3/1965 Wrightman ..... 280/21 R
3,357,714 12/1967 Kuehn ..... 280/818
3,751,056 8/1973 Wightman ..... 280/818

FOREIGN PATENT DOCUMENTS 1127678 7/1982 Canada ..... 280/818
2653701 11/1976 Fed. Rep. of Germany .
2156658 9/1972 France .
2570611 9/1984 France .

*Primary Examiner*—David M. Mitchell
*Assistant Examiner*—Richard Camby
*Attorney, Agent, or Firm*—Robert J. Koch

[57] ABSTRACT

The invention provides a device for joining two skis together, which is readily removable with the skis on the feet, including a connection means formed by a bar of variable length, with fittings at both its ends for articulating through several degrees of freedom, themselves connected to the ski tips by fastening-unfastening fittings formed by a male part and a female part secured to the articulation fitting and the other to the ski tips. The parts are lockable-unlockable by fitting together, then rotation by a particular amplitude, about an axis perpendicular to the plane of the ski tips, of the part secure to the articulation fitting characterized in that the articulation fitting are formed by a piece in the form of a diabolo or similar shape, made from a resilient material, at least one of the ends is mounted for swiveling and in that the connection bar is formed of a rod with ends of enlarged diameter sliding freely in cylindrical sleeves connected to one of the ends of the diabolo shaped piece.

6 Claims, 5 Drawing Sheets

FIG. 6
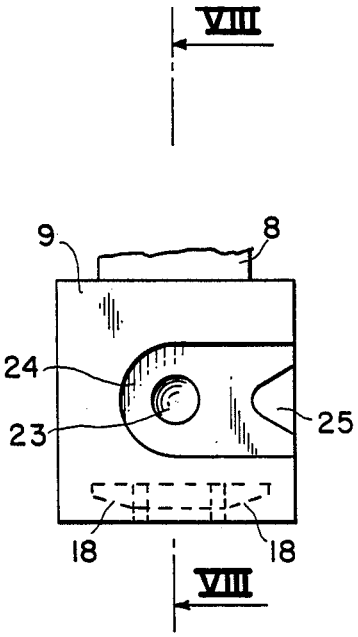
FIG. 8
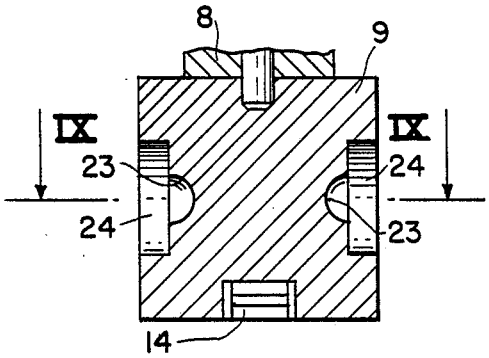
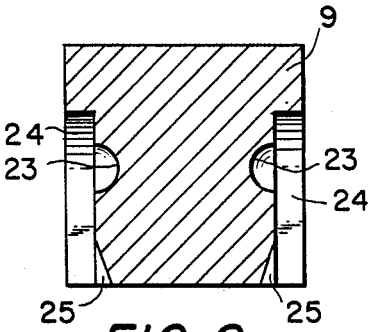
FIG. 9
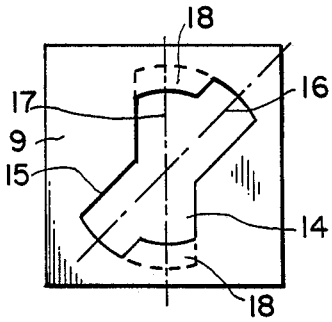
FIG. 7

DEVICE FOR JOINING TWO SKIS TOGETHER WHICH IS READILY REMOVABLE WITH THE SKIS ON THE FEET

BACKGROUND OF THE INVENTION

1. Field of the Invention

The present invention relates to a device for joining two skis together so as to avoid more particularly the crossing of the ski tips, while conferring thereon certain degrees of mutual freedom and which can be rapidly and readily positioned on or removed from the ski tips, even with the skis on the feet.

2. Description of the Related Technology

A certain number of devices are already known, which are used either solely at the front of the skis, or at the front and at the rear.

These devices however have drawbacks, from the safety point of view and, from the point of view of facilitating positioning on or removing from the skis.

The document No. FR 79 14681 describes a joining device including a connection rod each end of which is articulated, through a ball joint, in a retention cage previously fixed to the ski.

However, the devices of this kind have a certain number of drawbacks.

The first of them resides in the fact that the spacing given to the two ski tips is unalterable, since it is determined by the length of the connection rod. Consequently, it is not possible to vary this spacing as a function of the snow conditions (packed snow or deep snow), or of the possibilities of the user (beginner or experienced skier) or else of the mode of skiing which this latter desires to practice (cross country or competition skiing). Furthermore, even if the possibility of removing the connecting rod is provided, such removal is not very practical and requires considerable time, and cannot be carried out with the skis on the feet all the more so since said retention cages are necessarly fitted on the curved tips of the skis for they cannot be placed elsewhere.

The document No. DE 1 945 977 relates to a device including connection rods mounted for sliding side by side, so as to form a connection of adjustable length, the junction between the skis taking place by means of a ball joint and cage system fixed to the end of the skis.

This device has the advantage of adjusting the spacing between the ski tips but, although it is removable, it cannot be removed or put back in place by the skier during the skiing session and, in any case, can absolutely not be removed with the skis on the feet.

The document U.S. Pat. No. 3,171,667 describes a device, mounted at the front and at the rear of the skis, comprising a bar which may be of variable length and whose ends are provided with ball joints forcibly fitted in a retention cage made from a resilient material fixed to the upper face of the skis.

This system has the drawbacks of not being able in practice to be removed with the skis on the feet.

In fact, if it is desired to have an efficient connection, the ball joints must be firmly retained, which increases correspondingly the force to be exerted so as to remove them from their housing, this only being possible with great difficulty with the skis on the feet. Furthermore, this device is unaesthetic for the bar remains on one of the two skis. Even if it were completely removed, there would permanently remain on the skis the reception cage of the ball joint which projects, for of appreciable dimensions, which may further modify the mechanical characteristics of the skis.

From the document U.S. Pat. No. 3,357,714 a device is also known for joining two skis together comprising a rigid connection rod, although adaptable in length, articulated at both ends to a connecting piece itself removably fixed to the ski tip by a retractable ball connection during unlocking when it is desired to remove the rod from the skis.

Such a system is fragile and does not withstand shocks. Furthermore, it is not very practical, even difficult or even impossible, to operate because of the risks of seizing or jamming of the sliding sleeve controlling retraction of the balls.

Finally, this system requires the fitting of the device on the internal edge of the skis (column 3, lines 24–25) so as to allow (FIG. 7) an angular position of 90° between the skis and their connecting rod, which results in a disymmetry of the skis causing wear which is twice as fast.

The different embodiments of the connection system between the rod and the skis has however, from different points of view, drawbacks from the safety point of view, from the point of view of the amplitude of the degrees of freedom allowed, of operation and are all fragile and do not withstand shocks because of the rigid connections between the different members.

SUMMARY OF THE INVENTION

The purpose of the invention is precisely to overcome these different drawbacks by providing a device for connecting two skis together with a junction bar of variable length and joined to the ski tips by means adapted for combining, on the one hand, efficiency and safety of the connection and, on the other, the ease and rapidity of fitting a device and removing it from the ski tips, in particular with the skis on the feet, while maintaining as much as possible the aesthetic appearance of the skis as well as the safety of the skier.

For this, the invention provides a device for joining two skis together, readily removable with the skis on the feet, including a connection system comprising a bar of variable length, having at both its ends means for articulating through several degrees of freedom, themselves connected to the ski tips of the skis, by fastening-unfastening means formed by a male part and a female part secured, one to said articulation means and the other to said ski tips, said parts being lockable-unlockable by fitting together then rotation, of a determined amplitude, about an axis perpendicular to the plane of the ski times, of the part secured to said articulation means, characterized in that said articulation means are formed by a piece in the form of a diabolo which is defined as a type of bobbin or spool formed by two opposing cones in an hourglass type configuration or similar structure, made from a resilient material, one at least of the ends of which is mounted for swivelling, and in that the connecting bar is formed of a rod with ends of enlarged diameter sliding freely in cylindrical sleeves connected to one of the ends of said diabolo shaped piece.

Such a device, because of the resilient diabolo shape of the articulation means and instantaneous and automatic adaptation of the length of the connection bar, allows degrees of freedom in all directions, with quite remarkable amplitude, flexibility and comfort.

The flexibility of the connection also allows the device to withstand forces and shocks, without damage, which applied to known devices would inevitably cause breakage thereof.

Other features and advantages will be clear from the following description of embodiments of the invention, which description is given by way of example solely with reference to the accompanying drawings.

BRIEF DESCRIPTION OF THE DRAWINGS

FIG. 6 is a partial left hand view in the direction of arrow VI of the device of FIG. 1;

FIG. 7 is a top view of the device of FIG. 6;

FIG. 8 is a sectional view through the line VIII—VIII of the device of FIG. 6;

FIG. 9 is a sectional view through the line IX—IX of the device of FIG. 8;

DETAILED DESCRIPTION OF THE PREFERRED EMBODIMENT

Figure 3:
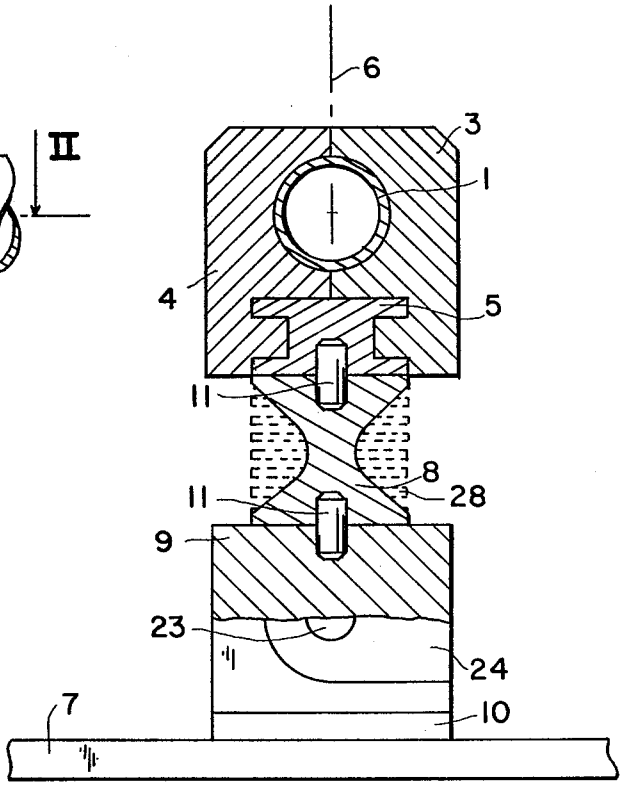
FIG. 3 is a vertical sectional view through line III—III of the device shown in FIG. 1.
Figure 1:
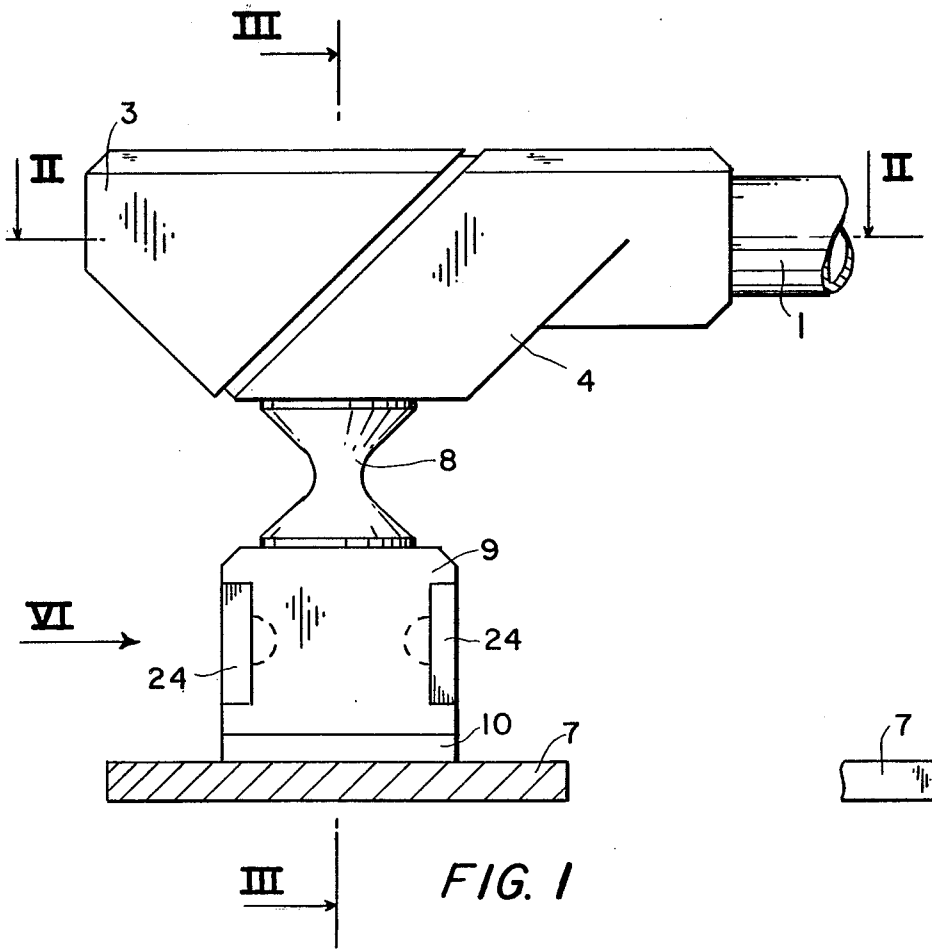
FIG. 1 is a schematical view in vertical cross section of a ski fitted with a connection device in accordance with the invention.
Figure 2:
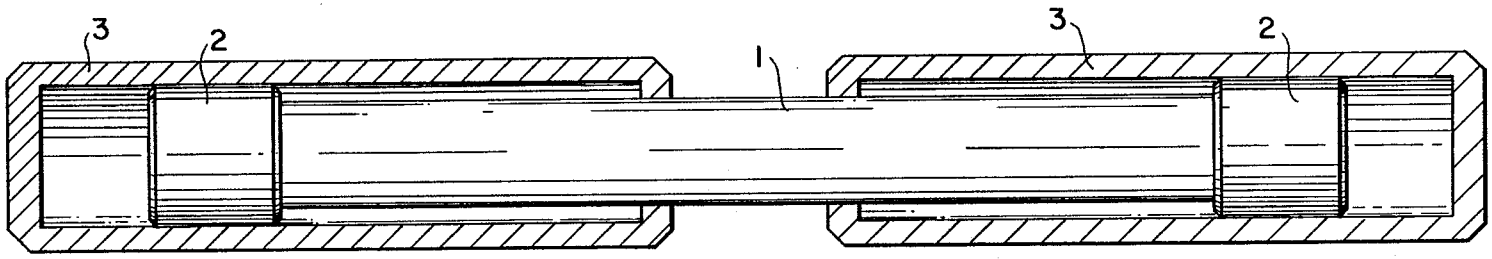
FIG. 2 is a sectional view through line II—II of the connecting bar (shown as a whole) of the device of FIG. 1.

The device shown in FIGS. 1 to 3 includes a connecting bar 1 whose ends 2 of enlarged diameter (FIG. 2), in the form of pistons, may freely slide in two cylindrical sleeves 3 each extended laterally and at their lower part by a portion 4 in which a collar 5 freely swivels whose axis 6 is perpendicular both to the axis of bar 1 and to the plane of the ski tip 7, in the center of which the device is mounted.

Collar 5 is integral with a piece 8 in the form of a diabolo, made from a resilient material, of the type forming the feet for the mast of a surfboard, itself secured to a substantially cubic block 9 (FIGS. 6 to 9) itself locked to plate 10 fixed permanently to the upper face of said ski tip 7.

The device is of course symmetrical with respect to the vertical median plane parallel to the two skis 7.

The diabolo shaped piece 8 is fixed to collar 5 and to block 9 by any appropriate means such as threaded rods 11 anchored in piece 8.

Such an assembly makes possible rotation of bar 1 through 360° about axis 6 as well as a rotation of wide amplitude, not only upwards but downwards, in every vertical plane including axis 6, because of the resilience of piece 8 whose axis emerges with said axis 6.

The assembly formed by bar 1, the end sleeves 3 and the articulation means 5, 8 may be very readily and very rapidly fixed to or removed from the ski tip 7, by providing between the ski tip 7 and said articulation means fastening unfastening means formed by the portion 9 integral with said articulation means 5, 8 and by the portion 10 integral with the ski tip 7, these two portions having mutual fitting means of the male and female type with locking by rotation of given amplitude of the mobile portion 9 about axis 6.

Figure 4:
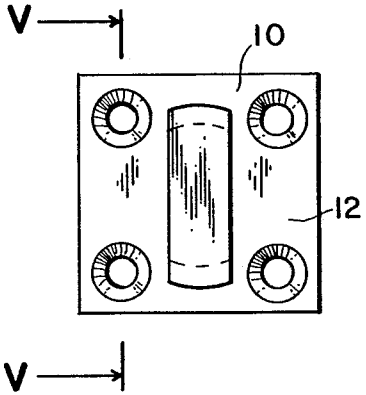
FIG. 4 is a top view of a first embodiment of a part of a device permanently fixed to each ski.
Figure 5:
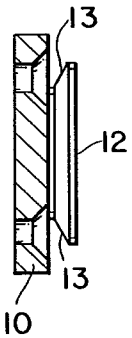
FIG. 5 is a sectional view through line V—V of the device shown in FIG. 4.

In the embodiment shown, the fixed portion 10 permanently fixed to the ski tip is formed (FIGS. 4, 5) of a square, for example a metal plate screwed to the upper face of the ski tip and having on its upper face a projection 12 of small height, of a rectangular shape, whose longitudinal axis is parallel to that of the ski. The projection 12 has, in a side view (FIGS. 5, 6), a general dove tail shape defining two slanted internal sides 13 whose purpose will be described further on.

Projection 12 is intended to be received in a housing 14 provided for this purpose in block 9 and opening through an opening 15 of a generally rectangular shape formed in the lower face of said block 9.

Housing 14 is shaped so as to receive said projection 12 and to make possible a rotation thereof in its housing through an angle for example of 45°, as shown in FIG. 7, where at 16 is shown the axis of the rectangular opening for insertion of projection 12 and, at 17, the axis of the final locked position of the projection in housing 14, this axis 17 being parallel to the longitudinal axis of the ski tip 7.

The housing 14 has two slanting internal opposite faces 18, in correspondance with the slanting faces 13 of projection 12.

For fixing block 9 on plate 10, it is sufficient to present the opening 15 with its axis 16 aligned with a longitudinal axis of the projection 12, to insert the projection in the housing 14 while driving in block 9, then to pivot this latter through 45°, in the desired direction, so as to bring axis 17 parallel to the ski 7.

The rotation of block 9 is very easy and does not require rotation of the assembly 1 to 4 because of the collar 5.

The cooperating slanting faces or ramps 13 and 18, through elastic friction, provide efficient holding in the final position, which may be locked for example by an end of travel snap fit system of known type.

Block 9 may be operated simply by hand, with the skier squatting, who has no need to remove his skis to position the device of the invention or remove it.

Figure 10:
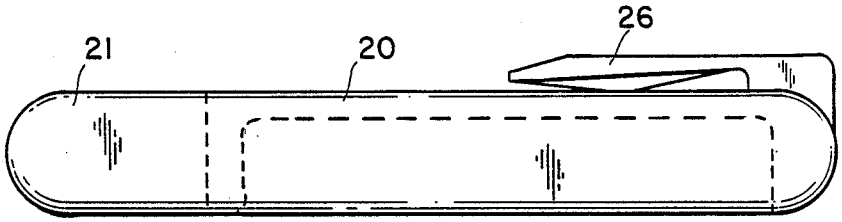
FIG. 10 is an elevational view of an appropriate tool for controlling rotation of the device of FIG. 6.
Figure 11:
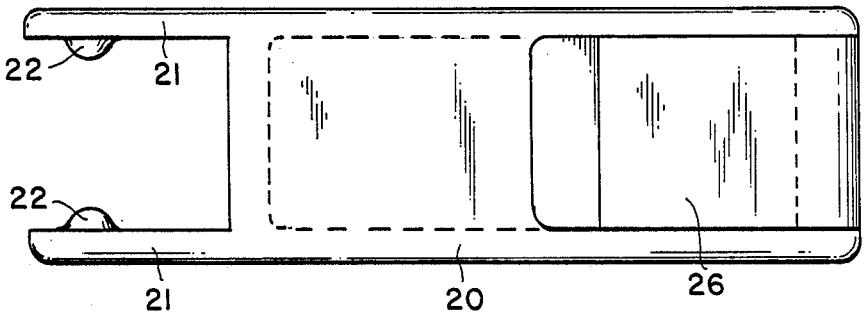
FIG. 11 is a top view of the tool of FIG. 10.

For further facilitating operation of the device with the skis on the feet, a special tool may be used in the shape of a fork shown in FIGS. 10 and 11.

This tool has an elongate body 20 with two parallel fingers 21 at one end having on their facing faces two projections 22 adapted for cooperating with two hollows 23 formed in two opposite faces of block 9. These opposite faces, preferably parallel to the axis of the skis, besides the hollows 23 have recesses 24 for receiving and locking the fingers 21 of the fork, facilitating correct positioning and operation of the fork 20, 21. In addition the bottom of said recesses 24 includes depressions 25 (FIG. 9) at the insertion ends of fingers 21 for facilitating their insertion.

The fork tool 20, 21 has a reduced dimension, is light (for example made from a plastic material) and may be readily carried, for example by means of a pin 26 for clipping it in a pocket in the manner of a pen.

The fork tool may have a greater length and comprise for example a telescopic or foldable handle for facilitating storage thereof.

The operation for rotating blocks 9 may also be performed using the tip of one of the skis sticks, which tip may for example be engaged in a hole formed for this purpose at an appropriate position in said blocks 9 or in an extension thereof, this hole having a truncated cone shape and having an axis slanted and turned towards the skier so a to facilitate insertion of the end of the ski tip.

Blocks 9 may also have one or more projections or recesses making possible direct, practical and efficient manual handling operation.

Figure 12:
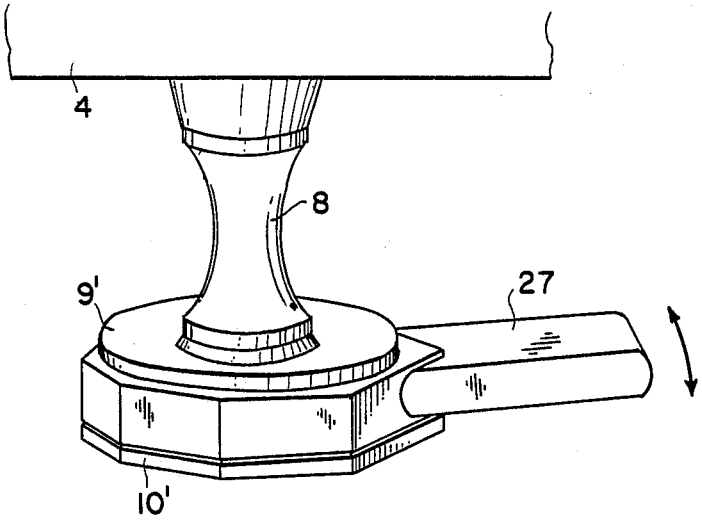
FIG. 12 shows in perspective another embodiment of the fixing-unfixing means.
Figure 13:
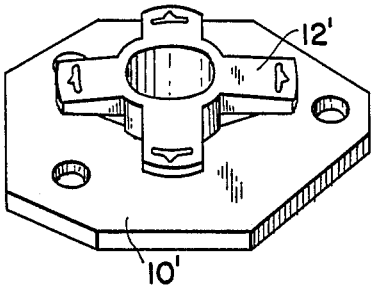
FIG. 13 shows a part of the device of FIG. 12 permanently fixed to the ski.

FIGS. 12 and 13 illustrate an embodiment in which the piece 9', similar to piece 9 of the embodiment shown in FIGS. 1 to 10, has a small height and is provided with a horizontal lateral extension 27 giving a ready hand hold for pivoting the assembly 8–9' through 45° with respect to plate 10', similar to plate 10 (permanently fixed to the ski tip not shown).

Plate 10' has on its upper face (FIG. 13) a cross shaped projection 12' similar to projection 12 and cooperating with a housing of the same type as housing 14 (FIG. 7) but adapted for receiving the cross shaped projection 12', formed on the lower face of piece 9'.

As in the embodiment shown in FIGS. 4 to 7, pieces 9', 10' pass from their locked position to their unlocked position by a rotation of 45°.

When the assembly 1 to 9 is removed, there only remains on the skis plates 10, 10' with their projection 12, 12', the assembly (10, 10'; 12, 12') having very modest dimensions and projecting little, so that it is not detrimental to the aesthetic appearance of the skis, nor to their performances or their qualities, nor to the safety of the skier who does not run the risk, for example, of hurting himself in contact with said elements should he fall or when removing his skis.

The elements 12, 12', on the one hand, and 14, on the other, could of course be reversed, by securing projection 12, 12' to piece 9, 9' and by forming the housing 14 in plate 10, 10', which would further have the merit of making the plates 10, 10' smooth and without projections.

Plates 10, 10' may also be in the form of inserts integrated in the mass of the ski tips 7, the upper face of the plates being flush with that of the ski tips.

The spacing between the two skis 7 is of couse adjustable automatically by sliding portions 2 of the bar in sleeves 3, this spacing being variable for example between 60 and 210 mm.

The device of the invention is mounted at the front of the skis between the tip and the shoe binding. A second similar device may be fitted at the rear of the binding. In the embodiment shown, pieces 8 are secured to pieces 9, 9' and the collars 5 swivel in sleeves 3, but the arrangement may just as well be reversed and pieces 8 be secured at their upper end to sleeves 3 and at their lower end to a collar similar to collar 5 and mounted for swivelling in pieces 9, 9'.

The coupling between portions 9, 9' and 10, 10' is of the bayonet type, but other embodiments of this type of connection are of course possible as well as, in a general way, any type of mutual fitting then locking by relative rotation of the members thus assembled.

Of course, the different pieces of the device of the invention may be made from different appropriate materials (plastic material, aluminium, rubber, composition materials, etc. . . . ).

The connecting bar 1, (solid or hollow) may be made from a relatively flexible plastic material allowing the bar to absorb the shocks and vibrations and to give greater flexibility to the device.

Pieces 3, 4 are preferably formed from two molded half shells, assembled together for example by bonding or screwing in a joint plane merging with the vertical plane of symmetry of the assembly 1, 2, 3. Before assembly, the elements internal to the half shells, namely pistons 2 and collar 5, are of course positioned.

It should also be noted that the device of the invention may be readily placed in a waiting position on a single ski, so that in particular mechanical ski lifts can be used without difficulty. For this, one of the ends of the device is removed from one of the skis and fixed to the other ski, which is provided at the appropriate position with a second plate 10, 10' on the projection 12, 12' of which the device is positioned and locked parallel to the ski.

Finally, the invention is obviously not limited to the embodiments shown and described above but covers on the contrary all variants thereof insofar as concerns the nature, shapes and arrangements of the two parts of said means for fixing the articulation means carrying the connecton bar to the ski of removing it therefrom, as well as the nature, shapes and arrangements of the diabolo shaped pieces 8, these latter in particular having a shape removed from that of a diabolo but offering the same possibilities.

It should be noted that the diabolo shaped piece 8 may have fins, made from the same material, as shown in broken lines at 28 in FIG. 3. Piece 8 thus has for example an external cylindrical appearance and withstands better the agressions of the edge of the opposite ski when the device is out of service.

We claim:

1. A device for joining two skis together, readily removable with the skis on the feet, including a connection system comprising a variable length bar, exhibiting means for articulating through several degrees of freedom arranged at both ends of said bar, said means for articulating are connected to the ski tips of the skis, by a fastening-unfastening device formed by a male part and a female part, one part of said fastening and unfastening device is secured to said means for articulating and a mating part is connected to said ski tips, said parts are lockable-unlockable by fitting together then rotation, of a determined amplitude, about an axis perpendicular to the plane of the ski tips, of the part secured to said means for articulating, wherein said means for articulating exhibit a diabolo or similar configuration and are made from a resilient material, one at least of the ends of said means for articulating is mounted for swivelling, and said connecting bar is a rod with enlarged diameter ends sliding freely and are retained in cylindrical sleeves connected to one of the ends of said diabolo shaped piece.

2. The device of claim 1, wherein said part of said fastening-unfastening device fixed to the ski tip is a thin plate fixed to the upper face of the ski tip and having a projection of small height, configured to be inserted and locked in a housing of complementary shape opening in a lower face of a part of said fastening-unfastening device secured to said means for articulating.

3. The device of claim 2, wherein said projection has a simple or cross shaped elongate rectangular shape and a longitudinal section in the form of a dovetail, and said housing has a complementary shape and opens into said lower face through a simple or cross shaped rectangular flat opening offset angularly with respect to the mutual locking axis of the male and female parts.

4. The device of claim 2, wherein said part of the fastening-unfastening device secured to the means for articulating is integral with said means for articulating and exhibits means adapted for facilitating rotation.

5. The device according to claim 4, wherein said means for facilitating rotation are formed by hollows in opposing faces of said part connected to said means for articulating and further comprising a fork shaped tool for gripping said means for facilitating rotation.

6. The device according to claim 4, wherein said means for facilitating rotation are horizontal lateral extension of said part of the fastening-unfastening device secured to said means for articulating.

* * * * *